US005337486A

United States Patent [19]

Brechtel

[11] Patent Number: 5,337,486

[45] Date of Patent: Aug. 16, 1994

[54] MECHANISM FOR ADJUSTING THE SKEW ANGLE OF INCLINATION OF A PRINTING PLATE ON ITS PLATE CYLINDER

[75] Inventor: Heinz Brechtel, Beindersheim, Fed. Rep. of Germany

[73] Assignee: MAN Roland Druckmaschinen AG, Fed. Rep. of Germany

[21] Appl. No.: 923,921

[22] PCT Filed: Dec. 28, 1991

[86] PCT No.: PCT/EP91/02518

§ 371 Date: Aug. 27, 1992

§ 102(e) Date: Aug. 27, 1992

[87] PCT Pub. No.: WO92/12012

PCT Pub. Date: Jul. 23, 1992

[30] Foreign Application Priority Data

Jan. 9, 1991 [DE] Fed. Rep. of Germany ..... 4100408

[51] Int. Cl.[5] ..... B41B 11/00

[52] U.S. Cl. ..... 33/617; 101/415.1

[58] Field of Search ..... 33/613, 614, 617, 618, 33/620, 621, 645; 101/378, 415.1, DIG. 36

[56] References Cited

U.S. PATENT DOCUMENTS

| | | | |
|---|---|---|---|
| 3,750,571 | 8/1973 | Germann | 101/415.1 |
| 4,259,904 | 4/1981 | Metje | 33/618 |
| 4,688,484 | 8/1987 | Herold et al. | 101/415.1 |
| 4,809,607 | 3/1989 | Dorow et al. | 101/415.1 |
| 4,977,833 | 12/1990 | Inage et al. | 101/415.1 |

FOREIGN PATENT DOCUMENTS

| | | |
|---|---|---|
| 0232730A2 | 8/1987 | European Pat. Off. . |
| 1536954 | 8/1971 | Fed. Rep. of Germany . |
| 3731642A1 | 3/1989 | Fed. Rep. of Germany . |

*Primary Examiner*—William A. Cuchlinski, Jr.
*Assistant Examiner*—G. Bradley Bennett
*Attorney, Agent, or Firm*—Leydig, Voit & Mayer, Ltd.

[57] ABSTRACT

A mechanism is described for adjusting the skew angle of inclination of a printing plate engaging the periphery of a plate cylinder, by means of a lever system which adjusts the edges of the printing plate in opposite directions. For this purpose, the two clamping bars are provided on a common baseplate which is lifted at one end prior to releasing the printing plate.

5 Claims, 3 Drawing Sheets

MECHANISM FOR ADJUSTING THE SKEW ANGLE OF INCLINATION OF A PRINTING PLATE ON ITS PLATE CYLINDER

FIELD OF THE INVENTION

The present invention relates generally to a mechanism for adjusting the skew angle of inclination (hereinafter often referred to simply as "the inclination") of a printing plate engaging the periphery of a plate cylinder, for the purpose of resister correction, the printing plate being releasably secured to clamping bars by its heading and trailing edges as considered in the direction of printing cylinder rotation.

More specifically, the invention concerns such a plate registry correction mechanism wherein the clamping bars are disposed in an axis-parallel gap in the periphery of the plate cylinder and are adjustable tangentially for clamping the printing plate. A pivotally mounted lever system also is provided in the cylinder gap and is articulated to the facing edges of the clamping bars to enable the latter to be moved in opposite directions and substantially in axis-parallel relationship for the inclination adjustment. The invention also relates to a mechanism for releasing and clamping a printing plate engaging the periphery of a plate cylinder. The leading and trailing edges of the printing plate as considered in the direction of printing rotation are releasably secured to clamping bars disposed in an axis-parallel gap in the plate cylinder and are adjustable tangentially for the purpose of clamping the printing plate. The clamping bars are movable where the ends of the printing plate are secured to them for the purpose of releasing and clamping the same, more particularly in conjunction with an inclination adjustment mechanism.

BACKGROUND OF THE INVENTION

Mechanisms of this kind are described more particularly in EP 232 730-A2. Pivotal levers are provided at the two axial ends of the cylinder gap for the inclination adjustment and are connected in an articulated manner to the edges of the printing plate, their pivot shafts fixed on the cylinder being disposed eccentrically with respect to the gap. To release or clamp the printing plate on the plate cylinder the clamping bars can be tilted about an axis-parallel axis.

However, it is not possible to obtain perfect inclination adjustment for resister correction with this known mechanism, because the pivot axes of the lever system are not situated in the center of the cylinder gap. Moreover, the mechanism described in the said patent for releasing and clamping the printing plate is of complicated construction because not only are pivot bearings necessary for the two clamping bars, but also care must be taken to ensure that the two clamping bars are pivoted in synchronism and opposite directions.

OBJECTS AND SUMMARY OF THE INVENTION

The present invention obviates foregoing disadvantages. The primary aim of the invention is to devise the mechanism such so that accurate adjustment of the inclination of the printing plate is possible with minimum complexity in terms of construction and with the minimum number of operations.

To solve this problem, the invention is characterised in that the two clamping bars are disposed on a common baseplate and displaceable relatively thereto, in that the lever system is mounted pivotally on the baseplate centrally between the two points of articulation of the lever system, in that the baseplate is mounted at one axial end to be pivotable in the tangential and radial directions with a substantially central arrangement of the pivot mounting with respect to the cylinder gap, and in that the baseplate is adjustable radially at the other axial end.

Since the components forming the inclination adjustment mechanism are disposed together with the clamping bars on a common baseplate, an appropriate pivoting movement of the baseplate enables the printing plate engaging the plate cylinder to be released so that it rests loosely on the periphery of the plate cylinder and can be displaced relatively thereto without difficulty. Displacement of the printing plate is by means of the lever system and the resulting inclination adjustment is very accurate, because the pivot point of the lever system—unlike the prior art indicated hereinbefore—is disposed centrally between the two points of articulation of the lever system at the edges of the printing plate.

Pivoting of the lever system is achieved in a simple manner in terms of construction in that an adjustment spindle engages the lever system, the spindle exerting a force substantially tangentially on the lever system. This arrangement also ensures that the force is transmitted with optimum lever arms.

After the inclination has been adjusted it may be found that there is a still a slight correction required to correct the register, possibly even after repeated inclination adjustments, as described above, each checked by means of printing proofs with the adjusted plate. For this reason, in the preferred embodiment of the invention, a fine adjustment is provided for one of the clamping bars in the axial direction, by means of which any remaining register errors can be compensated for.

Starting from a mechanism for releasing and clamping a printing plate engaging the periphery of a plate cylinder, a further object of the invention is to arrange the mechanism so that release and clamping of the printing plate is possible in a simple manner in terms of construction.

Accordingly, the invention is characterised in that the two clamping bars are disposed on a common baseplate and are displaceable relatively thereto, said baseplate being adjustable radially at least at one end.

In carrying out this aspect of the invention, use is made or the surprising finding that lifting of the baseplate and, with it, the two clamping bars at just one axial end of the cylinder gap, is sufficient to release the previously clamped printing plate. In this lifting movement, in fact, the end zones of the printing plate which are bent in the tangential direction in the clamped condition are stretched and this stretch is sufficient to release the printing plate from the plate cylinder so that the printing plate can be displaced relatively to the plate cylinder periphery, preferably for the above-described inclination adjustment for register correction.

For this purpose, the baseplate can be lifted appropriately at the two axial ends. However, it is sufficient for it to be lifted at just one end. In this preferred embodiment the baseplate is pivotally mounted at its other axial end.

The invention is explained in detail below with reference to an exemplified embodiment which shows other important features.

DETAILED DESCRIPTION OF A PREFERRED EMBODIMENT

Figure 2:
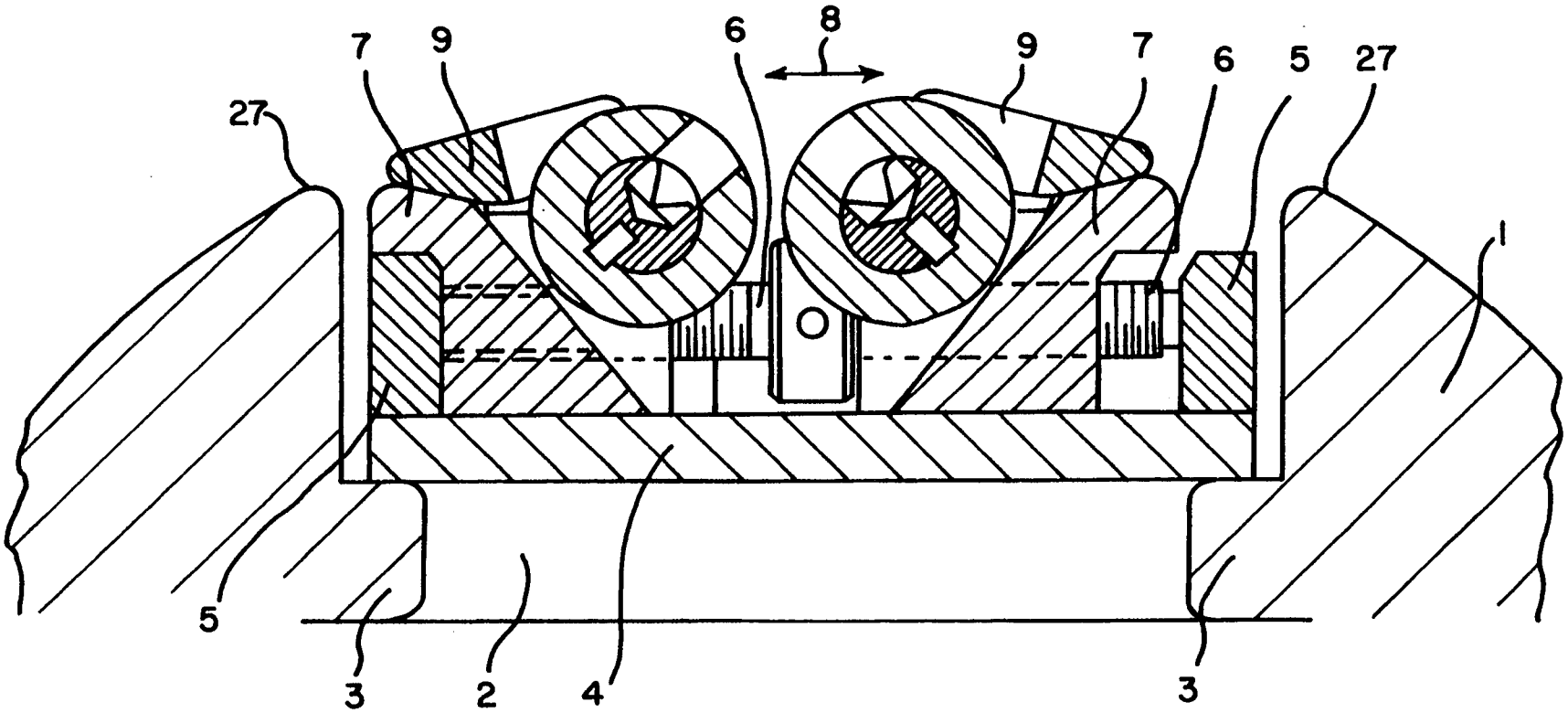
FIG. 2 is a cross-section through FIG. 1, substantially as seen along line 2—2, showing other details of the invention.

The drawing illustrate a plate cylinder 1 having an axial gap 2. Lateral shoulders 3 are formed in the gap and support a baseplate 4. Edge strips 5 are rigidly connected to the tangential ends of the baseplate. Clamping screws 6 are provided and are screwed into screwthreads of clamping bars 7. The clamping screws are fixed in the edge strips 5 so that the tangential position can be adjusted in the direction of the double arrow 8 of the clamping bars in FIG. 2, by means of the clamping screws.

Clamping flaps 9 co-operate with the clamping bars 7 so that the leading and trailing edges 34 and 35 of a printing plate 36 can be clamped between the actual clamping bars and their clamping flaps. The clamping flaps are moved by means of their clamping bars. (FIG. 3 omits the head of the right-hand clamping screw 6 in order to simplify the drawing. )

A lever system 10 (see FIG. 1) is secured to the baseplate 4 so as to be rotatable about a spindle 11 which is on the center-line 12 of the gap 2. Rollers 13, 14, 15 are fixed to the lever system, the rollers 13, 14 engaging in slots 16 in the clamping bars 7 while the roller 15 is situated between flanges 17 of an adjustment spindle 18.

Figure 1:
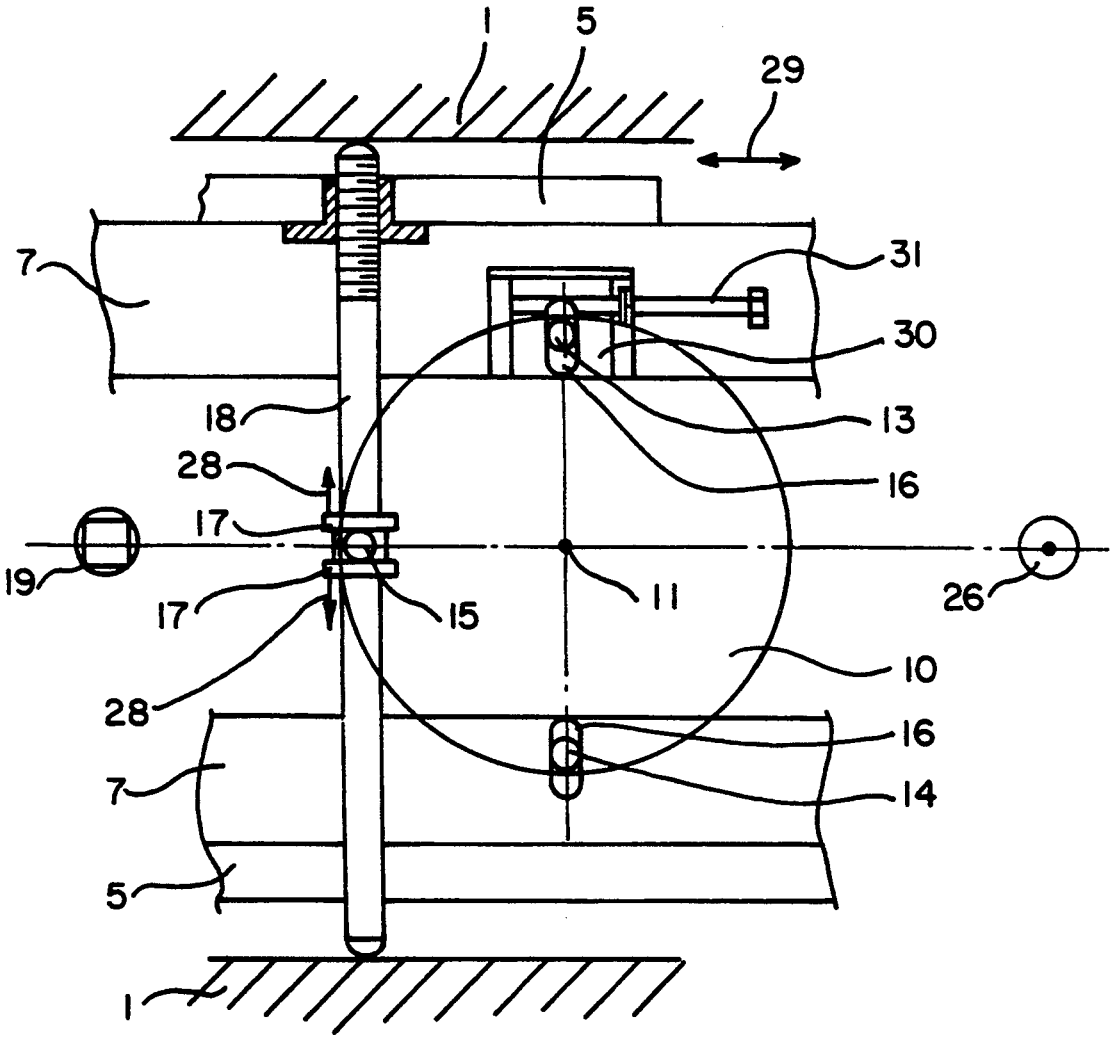
FIG. 1 is a diagrammatic plan view of a plate cylinder gap showing the essential components of the mechanism according to the invention in order to explain the principle.

The baseplate 4 can be moved in the radial direction at one axial end, i.e. can be lifted and lowered. For this purpose, a height adjustment spindle shown at reference 19 in FIG. 1 is provided, and is shown in detail in FIG. 3. It will be seen from this that the spindle 19 is screwed into a tapped bore 20 in the plate cylinder. On rotation of the adjustment spindle 19, the baseplate 4 is moved up or down in the direction of the arrow 22 by way of a locking ring 21, and with it the clamping bars and the other components fixed on the baseplate.

Figure 3:
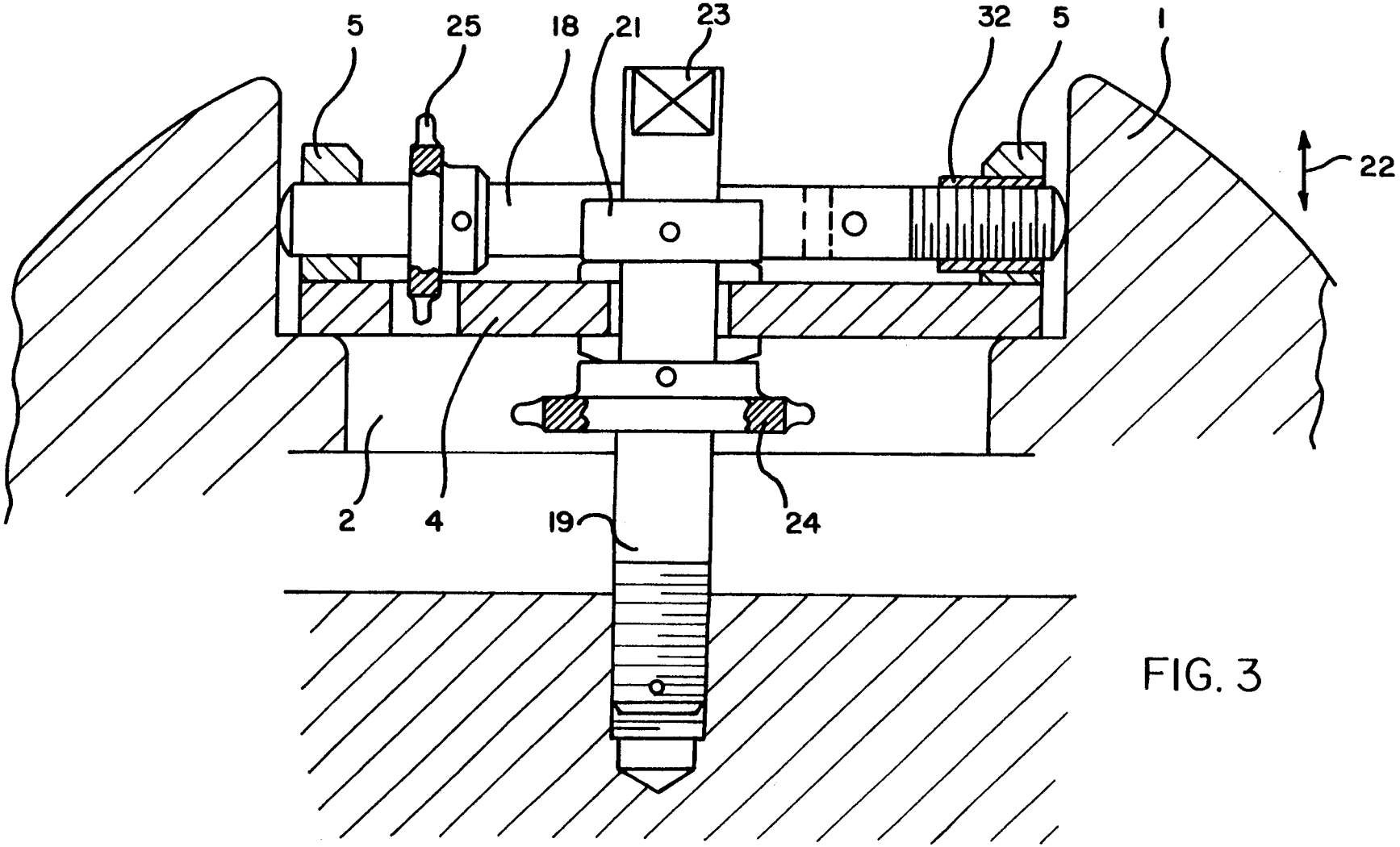
FIG. 3 is also a cross-section through FIG. 1, substantially as seen along line 3—3, additionally showing the height adjustment spindle and the inclination adjustment spindle of the invention.

FIG. 3 also shows that the adjustment spindle 19 can either be rotated manually, for which purpose a polygonal key can be applied to the spindle at reference 23, or it can be moved by motor, for example, by way of a gearwheel or sprocket wheel 24.

The lateral adjustment spindle 18 can also be moved manually or by motor, for which purpose FIG. 3 again shows a gearwheel or sprocket wheel 25.

At the other axial end the baseplate 4 is mounted rotatably and pivotally on the plate cylinder at reference 26. This mounting 26 (see FIG. 1) is, for example, in the form of a ball bearing, the baseplate being laterally pivotable in accordance with the adjustment or the spindle 18 and vertically pivotable in accordance with the adjustment of the spindle 19.

To incline the printing plate 36, the latter is first released, it being assumed that the printing plate 36 is clamped fast by its edges by means of the clamping bars 7, 9. To release the printing plate, the height adjustment spindle 19 is actuated, so that the associated end of the baseplate is moved upwards in the direction of arrow 22. The printing plate 36, which was bent out of its circular form in the direction of a tangential over the edges 27 of the plate cylinder on the transition from the periphery of the latter to the gap, is thus stretched and the printing plate material thus freed enables the printing plate to be so released from the periphery from the plate cylinder that the printing plate can now be moved relatively to the plate cylinder.

The spindle 18 is now rotated so that the lever system 10 is moved to the right or left in the direction of arrow 28 in FIG. 1 by way of the roller 15. The resulting pivoting of the lever system 10 about the axis 11 results in the spaced apart clamping bars 7 and their associated clamping flaps 9 being moved in opposite directions axially, i.e. in the direction of the double arrow 29 in FIG. 1. This is the required inclination adjustment. The printer now prints a proof, by rotating the cylinder 1 and attached plate 36 in the direction of printing rotation, shown by arrow 38 in FIG. 2, and if register is not yet achieved he will adjust to one or other additional inclined positions, as described above, until register is achieved. The height adjustment spindle 19 is then actuated to bring the baseplate 4 back to bear on the shoulders 3 end thus fix it on the cylinder 1. The printing plate 36 is now also clamped fast on the plate cylinder and accurate-register printing is possible.

It may be necessary for fine correction to be carried out beforehand, for which purpose the slot 16 associated with the roller 13 is formed in a block 30 which has a tapped bore in which an adjustment screw 31 engages by its screwthreaded end. When the adjustment screw is turned, the block is finely adjusted accordingly in the axial direction (arrow 29) and this displacement acts by way or the lever system 10 to produce a corresponding displacement of the other clamping bar in the opposite direction.

It will therefore be seen that the mechanism according to the invention is simple to operate and gives a very accurate inclination adjustment. The printing plate 36 has to be released—by means of the height adjustment spindle 19—end the necessary inclination adjustment can then be effected by actuating the side adjustment spindle 18. A peripheral correction is simultaneously achieved as a result.

With the described inclination adjustment or inclination correction, there may be peripheral and lateral shifts, but they can be compensated for by means of the peripheral and side resister control on the associated sheet-fed printing machine.

It is therefore important that once the plate 36 has been clamped in position by the clamping bars 7 it can remain clamped thereon during the inclination adjustment. If the printing plate were to be frequently released end clamped at the clamping bars, it might be damaged. This applies particularly to the very thin printing plates customary today. These disadvantages are obviated by the invention.

The mechanism described can also be varied in respect of its constructional details. For example, a screwthreaded nut can be screwed on to the lateral adjustment spindle 18 and be pivotally connected to the lever system 10 so that when the spindle is rotated the nut travels along the spindle end thus shifts the clamping strips. The lever system 10 is denoted by a circle in FIG. 1 but it may have other forms, for example a three-armed lever.

FIG. 3 also shows that the adjustment spindle 18 engages by a screwthreaded end in a co-acting thread of a screwthreaded member 32 fixed in a through hole in the associated edge strip 5. At the other end the adjustment spindle 18 extends through a through hole in the other edge strip 5.

It should be noted that FIG. 1 is not a true-to-scale drawing; the distance between the adjustment system comprising the lever system 10 and the height adjustment spindle 19 and the mounting 26 is larger than shown in FIG. 1, because the spindle 19 and the mounting 26 are situated near the axial ends of the cylinder gap 2.

In the released position—the baseplate lifted by means of the spindle 19—the clamping bars can be shifted in the direction of arrow 29. The clamping screws 6 do not obstruct this movement because they are moved together with the clamping bars. In addition, the displacement travel is generally only a few millimeters.

FIG. 1 also shows that the adjustment spindle 18 bears against the walls of the gap 2 by its points. Nevertheless, the roller 15 can be moved in the direction of arrow 28 because on rotation of the adjustment spindle 18 the entire clamping mechanism is shifted in the gap. This shift is also only a few millimeters.

I claim:

1. A mechanism for adjusting the skew angle of inclination of a printing plate mounted on the periphery of a rotatable plate cylinder in a printing press for the purpose of register connection, wherein the plate cylinder has an axis-parallel gap in the periphery thereof, said printing plate has leading and trailing edges with respect to the direction of printing rotation of the plate cylinder, and a pair of substantially axis-parallel clamping bars disposed in the gap for movement substantially tangentially with respect to the plate cylinder periphery for releasably clamping the leading and trailing edges of the printing plate to tension the plate on the periphery of the plate cylinder, said inclination-adjusting mechanism comprising, in combination, a base plate disposed in said gap and means for supporting said clamping bars for axial and tangential movement thereon, means for radially raising and lowering at least one axial end of said base plate in said gap for loosening and tightening the printing plate on the periphery of the plate cylinder, an articulated linkage including separate lever arms pivotally mounted substantially centrally on said base plate and operatively connected to said clamping bars for moving said clamping bars substantially axially with respect to said base plate and substantially oppositely with respect to one another for adjusting the skew angle of inclination of the printing plate on the periphery of the plate cylinder, and means including a common lever arm for pivoting said separate lever arms of said articulated linkage while the printing plate is loosened on the periphery of the plate cylinder for adjusting the skew angle of inclination of the plate thereon.

2. An adjusting mechanism according to claim 1 wherein said means for pivoting said common arm of said articulated linkage includes an adjustment spindle disposed to exert a substantially tangential pivoting force on said common arm.

3. An adjusting mechanism according to either claim 1 or 2 wherein a registry adjustment means including a threaded adjustment block and a fine adjustment screw are interposed between one of said separate lever arms and one of said clamping bars for adjusting said operative connection therebetween.

4. An adjusting mechanism according to either claim 1 or 2 wherein said means for radially raising or lowering said one axial end of said base plate includes a radial adjustment spindle interposed between said one end of said base plate and said gap in said plate cylinder periphery.

5. An adjustment mechanism according to claim 4 wherein the other axial end of said base plate is pivotally mounted in said gap.

* * * * *